United States Patent [19]

Tea

[11] 4,323,008

[45] Apr. 6, 1982

[54] VERTICAL BALING MACHINE FOR WASTE MATERIAL

[76] Inventor: Frank C. Tea, #192 N. County Rd. 312, Bellevue, Ohio 44811

[21] Appl. No.: 196,695

[22] Filed: Oct. 14, 1980

[51] Int. Cl.[3] ..... B30B 1/32

[52] U.S. Cl. ..... 100/214; 100/245; 100/255; 100/258 R; 100/269 R

[58] Field of Search ..... 100/214, 231, 46, 258 R, 100/258 A, 245, 229 A, 255, 269 R

[56] References Cited

U.S. PATENT DOCUMENTS

| | | | |
|---|---|---|---|
| 1,467,201 | 9/1923 | Shriver | 100/258 A |
| 2,738,856 | 3/1956 | Perlis | 100/258 R |
| 3,862,595 | 1/1975 | Longo | 100/229 A |
| 3,911,807 | 10/1975 | Birnbaum | 100/229 A |
| 4,041,856 | 8/1977 | Fox | 100/245 |
| 4,057,009 | 11/1977 | Burford | 100/46 |

*Primary Examiner*—Billy J. Wilhite

*Attorney, Agent, or Firm*—Wilson, Fraser, Barker & Clemens

[57] ABSTRACT

A baling machine having a cabinet provided with a central baling chamber and a closet on opposite sides of the baling chamber. A pressure platen operates in the baling chamber and fluid-pressure operated means located in one closet imparts up and down movement to the platen by connection to one side thereof. Two sets of cables and sheaves are arranged in respective closets and connect opposite sides of the platen for equalizing the platen pressure in each direction of movement. The cables can be adjusted not only to take up slack but also to level the platen.

3 Claims, 3 Drawing Figures

VERTICAL BALING MACHINE FOR WASTE MATERIAL

BACKGROUND OF THE INVENTION

1. Field of the Invention

This invention relates to baling machines of the type used to press or compact waste material such as cans and fibrous materials, and particularly to such a baling machine in which the platen moves vertically.

2. Description of the Prior Art

Vertical or downstroke baling machines for waste material are commonly used to bale aluminum beverage cans, tin cans, other non-ferrous scrap, and secondary fiber materials. These baling machines commonly comprise a housing or cabinet having a baling chamber therein and having a vertically movable upper front door which may be opened for the insertion of material to be baled into the chamber and having a hinged lower front door which is opened to remove the bale of material from the chamber. A platen is mounted to be vertically movable within the baling chamber. The platen is in its raised upper position for the insertion of waste material into the baling machine, and is moved downwardly to compress the material into the finished bale. The platen is pushed downwardly by suitable hydraulic ram means.

Prior art baling machines of this type have commonly utilized a single hydraulic cylinder on top of the baling machine to serve as a ram means for pushing the platen downwardly. The top-mounted hydraulic cylinder, however, occupied considerable space above the machine and resulted in a baling machine having an excessive height. Because of its height, such a baling machine could not be located in many standard size rooms or work areas where the ceiling is less than the overall height of the machine. In some instances, in order to accommodate these baling machines, users have cut holes in ceilings to provide sufficient clearance for the machines.

To reduce the overall height of such baling machines, other types of machines have been developed which have a pair of side-mounted hydraulic cylinders instead of a single top-mounted cylinder. While the pair of side-mounted cylinders have resulted in a reduction in the overall height of the overall height of the baling machines, the two-cylinder design required costly and complicated hydraulic valving to assure that the cylinders operated uniformly and simultaneously to pull the platen down equally on both sides. If the operation of one cylinder was not exactly equal to that of the other cylinder, the platen may jam, or serious damage could result to the baling machine. As a result, the hydraulic supply system for the two-cylinder baling machine must be designed in such a manner that it assures that both cylinders operate together. This design often requires special balancing means to assure that equal amounts of hydraulic fluid are supplied to both cylinders and other specialized and complicated components.

In accordance with another design, a single hydraulic cylinder for actuating the platen-shifting ram is disposed rearwardly of the baling chamber instead of on top. However, this was found objectionable and inefficient not only because of the greater space in depth required but also because the application of power to the platen created a cantilever action which resulted in a cramping or jamming and thereby interferring with the free platen movement.

SUMMARY OF THE INVENTION

In accordance with the invention, there is provided a low profile, single-cylinder baler in which the cylinder is mounted at one side of the baling chamber. To insure free up and down movement of the pressure platen in the baling chamber in response to the hydraulic cylinder and components, flexible connection between the side of the platen receiving the power stroke and the opposite side, transmit corresponding power both on the upstroke and downstroke, thereby obviating binding or cramping of the platen. The flexible connections may be in the form of cables trained over suitably located sheaves which create a pulling force on the side of the platen remote from the hydraulic drive. Since cables become elongated after use, provision is made to adjust the tension and this also enables levelling of the platen. Although prevention of the platen binding is of particular importance on the down or working stroke, nevertheless provision is made to prevent binding of the platen as it is being retracted or moved upwardly. On either side of the baling chamber is a closet which not only encloses the respective cables and sheaves but also contains on one side of the hydraulic drive components. The baling machine is of low profile and occupies a minimum amount of space. The hydraulic cylinder is so mounted that it can be lowered for shipment by simply removing retaining bolts.

DETAILED DESCRIPTION OF THE PREFERRED EMBODIMENT

Figure 1:
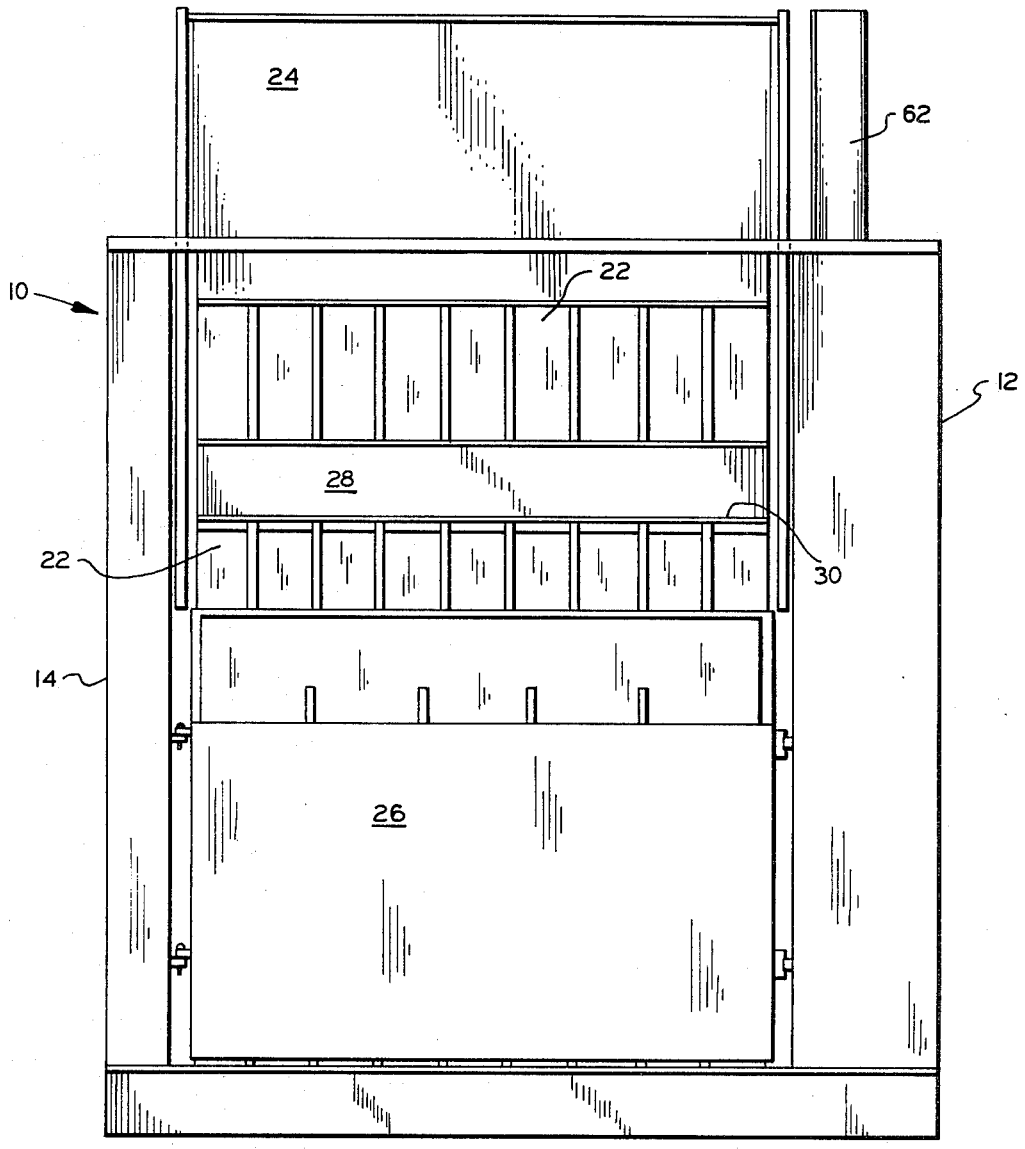
FIG. 1 is a front or face view in elevation of the baling machine in accordance with the invention.

The illustrated embodiment of the invention comprises a rectagonal cabinet 10 provided with opposite side walls 12 and 14, an open top 18 and a vertically slotted rear wall 16. A floor 20 of the cabinet is also slotted, the slots lining with those of the rear wall 16. The slots enable bale ties such as wires or straps to be introduced to wrap around the bale as is well understood. Within the cabinet is a baling chamber 22 which is enclosed by a vertically slidable upper door 24 and a side hinged lower door 26. The upper door 24 is shown in FIG. 1 raised to its upper position to enable material to be baled, such as cardboard containers, non-ferrous scrap, aluminum cans and the like, to be introduced into the baling chamber. After the material has been pressed into a finished bale, the lower door 26 is opened for removal of the compressed material.

Within the baling chamber 22 for vertical movements is a pressure platen having a horizontal beam 28 to the lower side of which is fixed a bottom pressure exerting plate 30 provided in the under face with a series of slots matching the slots in the rear wall 16. The plate 30 has approximately the length and breadth of the baling chamber 22 in order to crush all material between it and the floor 20.

On the left side of the platen (FIG. 3) is a depending guide plate 32 which is welded at its upper end to the side of the platen and rides up and down in a vertical slot 34 in the side wall 36 of the baling chamber 22. The side wall 36 is spaced inwardly from cabinet side wall 14, thereby providing an enclosure or closet A for cables, sheaves and associated parts as will hereinafter appear.

Figure 2:
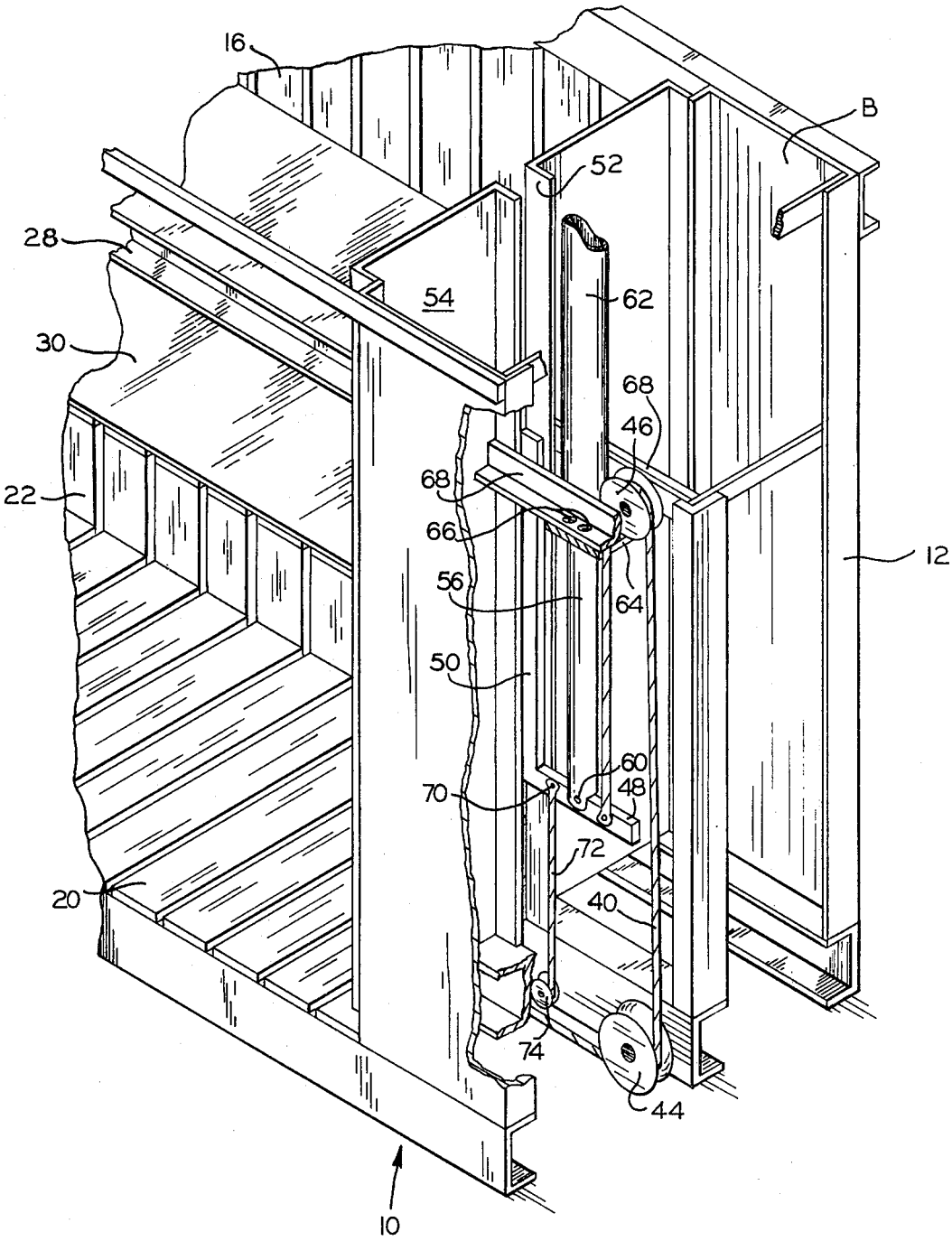
FIG. 2 is a top perspective view of one side of the machine with portions broken away to show the attachment of the hydraulic ram at one side of the baling platen and the associated cable and sheave arrangement.

Screw threadedly connected to a bracket on the lower end of the guide plate 32 is a rod 38 having a lower looped end to receive the looped end of a flexible cable 40. The cable 40 passes downwardly to and around a sheave 42 and then extends horizontally beneath the floor 20 of the baling chamber to a sheave 44 at the opposite side of the chamber (FIG. 2). After passing about the sheave 44, the cable 40 extends upwardly to a sheave 46 disposed near the top of the cabinet 10. The cable 40 finally extends downwardly from the sheave 46 to a horizontal bracket arm 48 to the outer end of which it is suitably anchored.

The bracket arm 48 is welded at its inner end to a vertically disposed guide plate 50, which is welded at its upper end to the right-hand side of the horizontal beam 28 of the platen. The guide plate 50 rides up and down in a vertical slot 52 provided in a right-hand side wall 54 of the baling chamber 22. The side wall 54 is spaced inwardly from the cabinet wall 12 and forms a closet B for the reception not only of cables and sheaves, but also hydraulic operating components as will appear.

A piston rod 56 has a yoke-like lower end which straddles the bracket arm 48 to which it is pivotally connected by a pin 60. On the upper end of the piston rod 56 is a piston (not shown) which reciprocates in a vertically disposed hydraulic cylinder 62. The cylinder 62 projects upwardly beyond the top of the cabinet, but no further than the upper limit of the vertically movable door 24 so as not otherwise to increase the overall height of the machine. The lower end of the cylinder 62 is fixed to a plate 64 secured by bolts 66 to angle iron brackets 68 which in turn are welded to adjacent wall portions. By removal of the bolts 66, the cylinder 62 may be lowered without difficulty for shipment.

Vertical movement is imparted to the horizontal beam 28 of the platen by the hydraulic cylinder 62, piston rod 56 and its piston and suitable pump, supply tank, power source and pipes which are not shown nor described, since they are well known in this art and form no part of the present invention.

Figure 3:
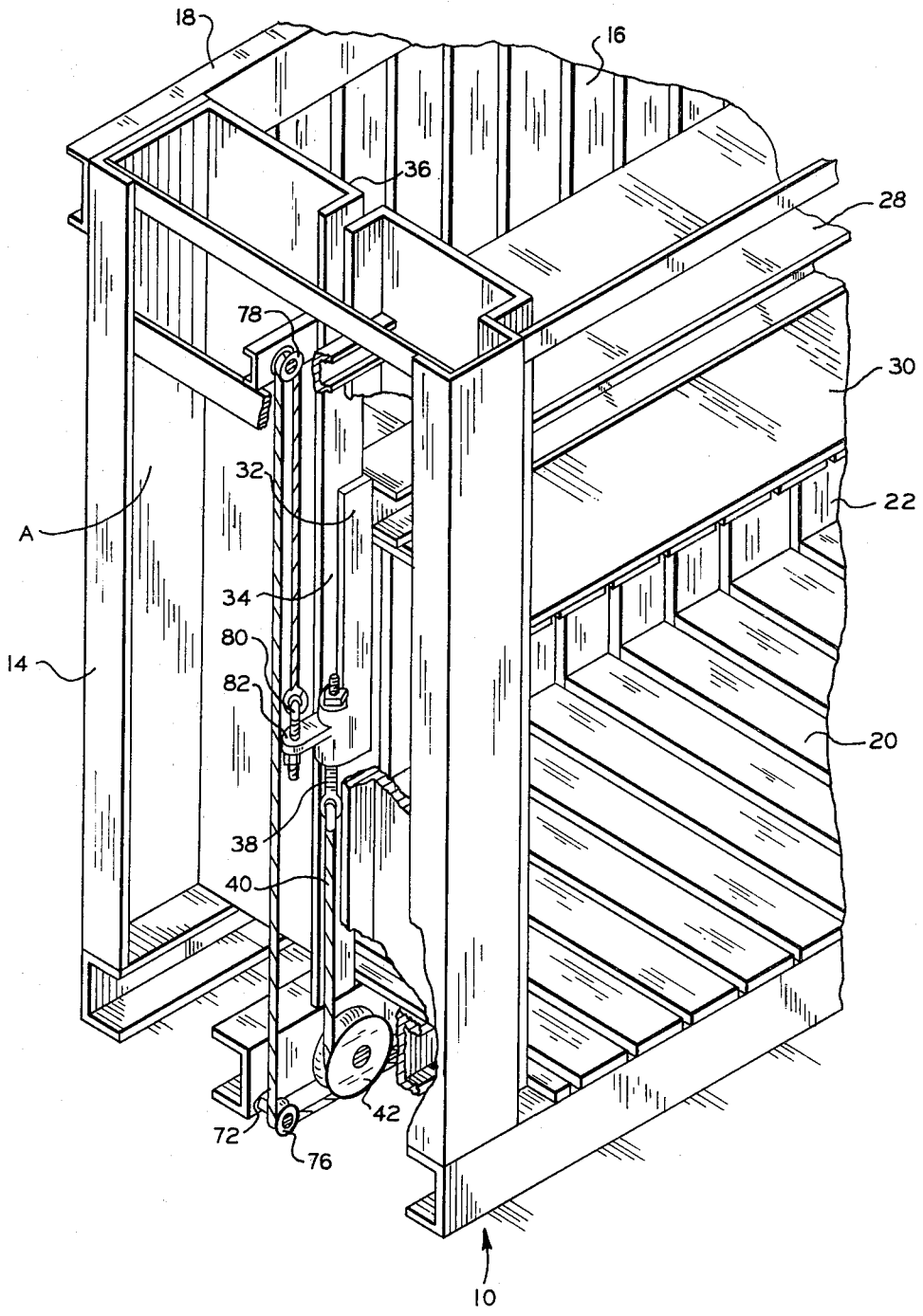
FIG. 3 is a top perspective view of the other side of the machine with portions broken away to show the cable and sheave arrangement, and the adjusting devices for cable slack.

Secured by a pin 70 to the inner end portion of the bracket arm 48 is an end of a flexible cable 72, which extends downwardly to a sheave 74 at the bottom of the closet B. From sheave 74 the cable 72 extends horizontally beneath the floor 20 to a sheave 76 at the bottom of closet A (FIG. 3). The cable extends upwardly from the sheave 76 to a sheave 78 disposed near the top of the cabinet in a position similar to that of the sheave 46 in closet B. From the sheave 78 the cable 72 extends downwardly to an adjustable anchor rod 80 which extends through a hole in a bracket 82 to receive a nut. The bracket 82 is welded to the guide plate 32.

In operation, the upper door 24 is in its raised position, the hinged door 26 is closed and the pressure plate 30 of the platen is raised so that the machine is prepared to receive into the baling chamber 22 the material to be baled. When sufficient material has been fed, then through the hydraulic components including the piston rod 56 and hydraulic cylinder 62, the pressure plate 30 of the platen is forced downwardly to effect the compacting operation. Thereafter, the hinged door 26 is swung open to discharge the compressed material in the form of a bale. Prior thereto, the bale is tied by wires, straps, or the like.

As the pressure plate 30 of the platen moves downwardly under the force of the hydraulic ram, its travel is limited by the depending guide plates 32 and 50 which in their lowermost positions bottom against floors of their respective closets, the movement however being adequate to compact the material for proper baling.

An important feature of the movement of the pressure plate 30 resides in the flexible cable and sheave assembly which functions to pull down one side of the platen when the hydraulic piston and cylinder assembly on the opposite side is energized. It will be apparent that when hydraulic pressure is exerted downwardly on the bracket arm 48, a pull is exerted upon the cable 40 which is so directed by the sheaves 46, 44 and 42 that a downward force is imparted to the other side of the platen through the guide plate 32. As a consequence binding or cramping of the pressure platen during its downward or working movement is prevented.

The cable 72 is effective in insuring smooth movement of the pressure plate 30 in its upward or retracting movement. Upon actuating the hydraulic ram to raise the plate 30, the pull on the cable 72 through the bracket arm 48 operates to impose a corresponding upward force on the opposite end of the platen through movement of the cable over the sheaves 74, 76 and 78 to the guide plate 32. Thus in either upward or downward movement of the pressure platen in response to the hydraulic components on one side of the platen, the opposite side is imparted a corresponding force to obviate any tendency to bind or cramp.

In order to compensate for any stretch of the cables 40 and 72, adjusting devices 38 and 80, respectively, are provided. These adjusting devices also enable levelling of the platen as will be readily understood.

The cables above described may be replaced by chains including sprocket chains trained over sprocket wheels instead of sheaves. Other changes in details of construction, arrangement and choice of materials may be effected without departing from the spirit and scope of the invention.

What I claim is:

1. A baling machine comprising a cabinet having side walls, a rear wall, and an open front adapted to be partially closed by movable doors, walls inwardly spaced from said side walls providing closets on opposite sides; a vertically movable pressure platen having guide plates on opposite ends; vertical guide slots in each inwardly spaced wall receiving said guide plates, respectively; fluid pressure means disposed in one closet and operatively connected to said platen; and equalizing means responsive to platen movement to equalize the pressure on both sides of said platen and having parts in each closet, said equalizing means comprising a flexible cable means and sheave arrangement disposed in said closets with the cable means extending from one closet to the other.

2. A baling machine as claimed in claim 1 in which said cable means and sheave arrangement includes a cable and sheave device operative respectively in each direction of the platen movement.

3. A baling machine as claimed in claim 2 including a bracket arm secured to the lower end of one guide plate, said bracket arm providing a common mounting for said fluid pressure means and said cable devices.

* * * * *